United States Patent [19]

Lovat

[11] Patent Number: 4,732,427

[45] Date of Patent: Mar. 22, 1988

[54] HEAD INTAKE FOR TUNNELLING MACHINE

[76] Inventor: Richard Lovat, 42 Grovetree Rd., Rexdale, Ontario, Canada, M9W 2Y2

[21] Appl. No.: 908,167

[22] Filed: Sep. 17, 1986

[51] Int. Cl.[4] ..... E21D 9/08

[52] U.S. Cl. ..... 299/33; 299/1; 405/144

[58] Field of Search ..... 299/1, 33, 11, 18; 405/144

[56] References Cited

U.S. PATENT DOCUMENTS

| | | | |
|---|---|---|---|
| 3,561,223 | 2/1971 | Tabor | 405/144 |
| 3,961,825 | 6/1976 | Lovat | 299/33 |
| 3,967,463 | 7/1976 | Grandori | 299/33 X |
| 4,167,289 | 9/1979 | Ono et al. | 299/1 |
| 4,311,344 | 1/1982 | Akesaka | 299/33 |
| 4,406,498 | 9/1983 | Akesaka | 405/144 X |
| 4,607,889 | 8/1986 | Hagimoto et al. | 299/11 X |

*Primary Examiner*—Stephen J. Novosad
*Assistant Examiner*—David J. Bagnell

[57] ABSTRACT

Apparatus for tunnelling through soil, in which a cutting head is rotatably mounted on a housing and atmospherically sealed from the housing. A muck ring is located in the housing to collect loose soil through an opening into the chamber of the muck ring and the opening is closable to maintain a pre-set earth pressure in the cutting head.

12 Claims, 4 Drawing Figures

HEAD INTAKE FOR TUNNELLING MACHINE

FIELD OF THE INVENTION

This invention relates to an apparatus for tunnelling through earth and more particularly to a head intake for a tunnelling machine.

BACKGROUND OF THE INVENTION

Earth tunnelling machines presently in use employ a toothed cutting head rotatably mounted on the end of a cylindrical housing. As the cutting head rotates and advances, the teeth on the head loosen the soil which passes through apertures in the head into the housing where it is collected and conveyed rearwardly. An example of such a head is disclosed in U.S. Pat. No. 3,961,825 issued June 8, 1976 to Lovat (the present inventor). In that particular apparatus movable doors are provided to control the entry of loose or soft soil through the cutting head into the housing and onto a conveyor, to prevent flooding. Full closure of the flood doors is made when loose or soft soil is being penetrated and the rotation of the cutting head has been stopped to advance and relocate the pushing rings at that end of the housing remote from the cutting head. Also in loose or soft soil it is desirable to close the flood doors where the apparatus is idle for a period of time, for example overnight, because when exposed to air the soil may increase in volume and flood the housing.

The problem with such a machine is that an excess of soil entering the machine in relation to the speed of advancement of the machine may cause the face of the tunnel to collapse if the soil at the face is loose and the flood gates do not react to the pressure change. Furthermore the pressure of the soil on the doors is perpendicular to their plane of movement to open and close.

It is an object of the invention to provide an improved tunnelling apparatus having a housing carrying a cutting head sealable from the housing.

It is another object of this invention to provide an improved cutting head for a tunnelling apparatus in which the soil transfer is controllable in response to earth pressure within the head.

SUMMARY OF THE INVENTION

Essentially the invention consists of apparatus for tunnelling through soil, comprising a housing, a cutting head rotatably mounted on one end of the housing and closing said one end, the head being sealed atmospherically from the housing, a muck ring fixed to the housing and projecting into the cutting head, the muck ring having an opening to receive loose soil collected within the cutting head, and closure means operable in response to earth pressure change within the cutting head to open and close the opening in the muck ring whereby a pre-set earth pressure in the cutting head is maintained in the cutting head.

BRIEF DESCRIPTION OF DRAWINGS

An example embodiment of the invention is shown in the accompanying drawings in which.

DESCRIPTION OF PREFERRED EMBODIMENT

Figure 1:
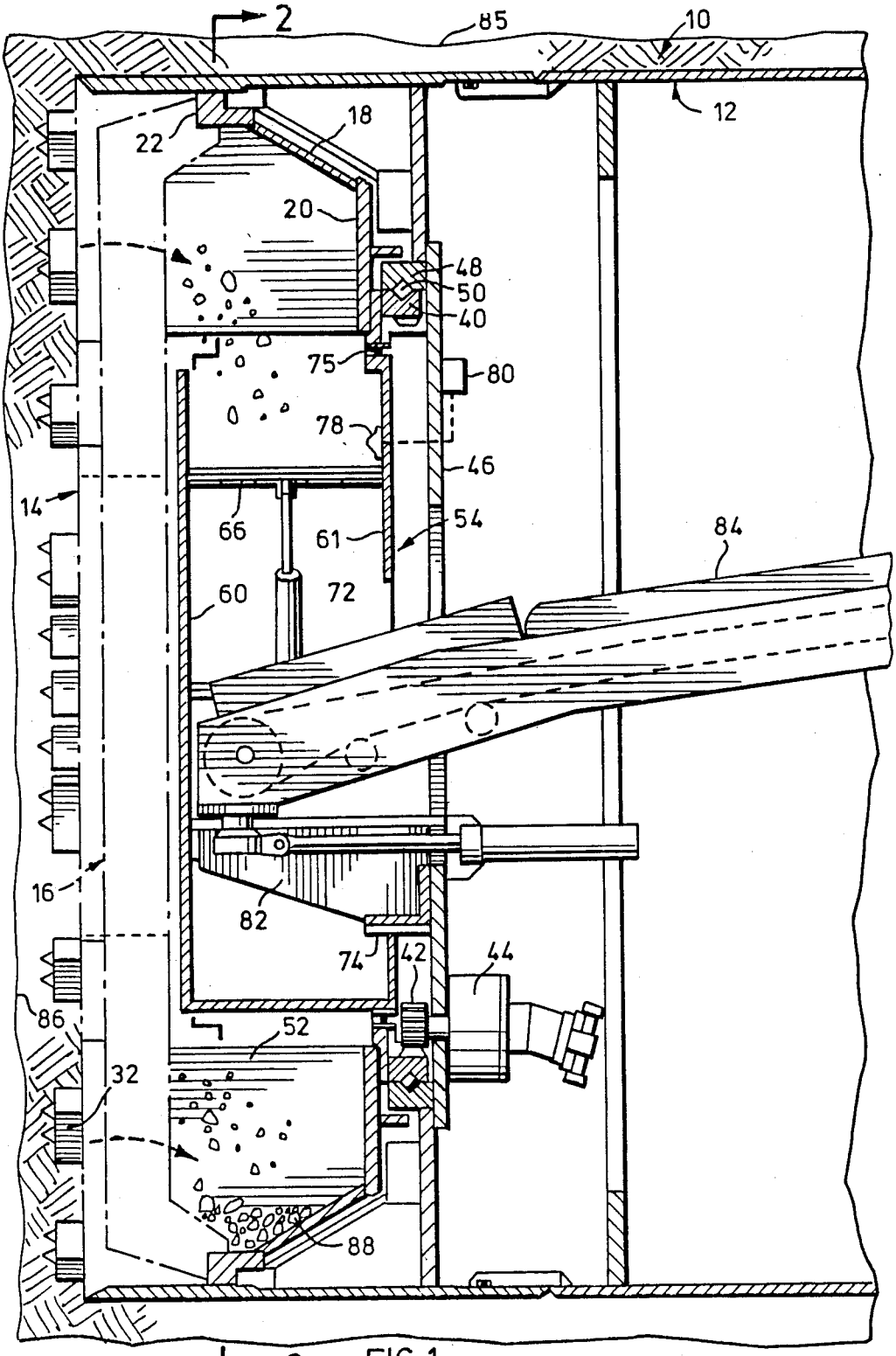
FIG. 1 is a cross-sectional view in elevation of a tunnelling machine and its head.

The example embodiment shown in the drawings consists of a tunnelling machine 10 having a cylindrical housing 12 in which a concentric cylindrical cutting head 14 is rotatably mounted.

Cutting head 14 comprises a face 16, a truncated conical side wall 18 and an annular rear wall 20 fixed to the side wall. Face 16 and side wall 18 are fixed together by a ring 22 concentric with housing 12. Face 16 comprises a plurality of fixed blind sectors 24 spaced apart to define aperture 26 between each sector. A plurality of radical cutter bars 28, superimposed on sectors 24, adjacent each aperture 26, extend radially from a hub 30. Each cutter bar 28 carries a row of cutter teeth 32 and both ring 22 and hub 30 each carry additional cutter teeth 34 and 36 respectively.

Rear wall 20 carries an internally toothed ring gear 40 engaged by a gear 42 driven by an hydraulic motor 44 mounted on an annular base plate 46 fixed to housing 12. Plate 46 also carries a bearing ring 48 which cooperates with ring gear 40 to form a cage for bearings 50 on which cutting head 14 rotates.

A plurality of loading plates 52 are fixed radially in cutting head 14 adjacent ring 22 and extend between sectors 24 and rear wall 20.

Figure 4:
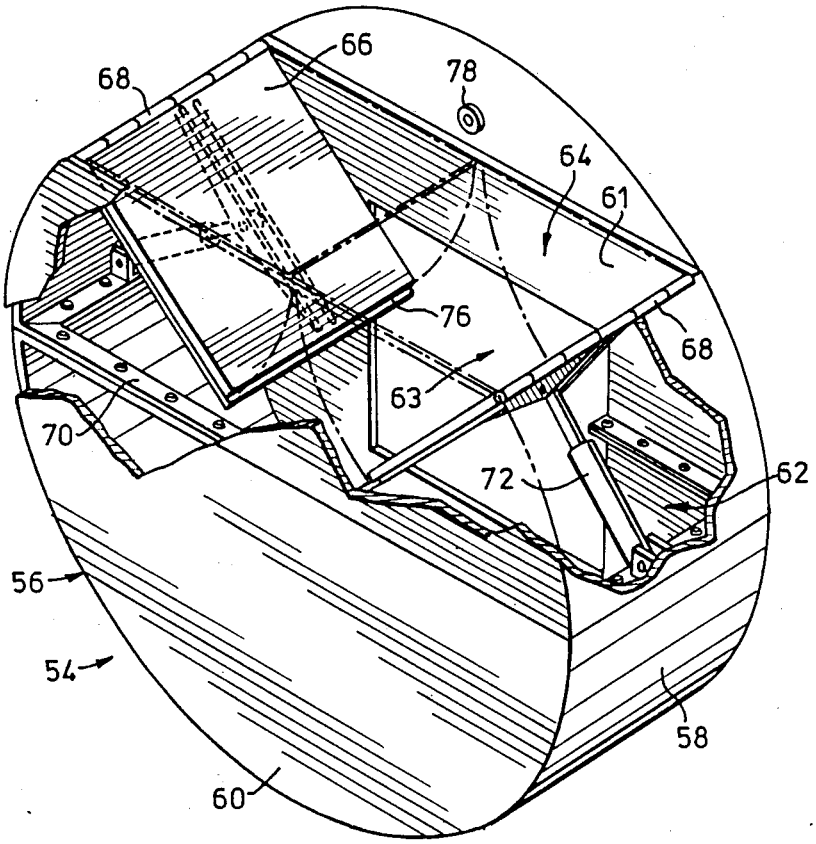
FIG. 4 is a perspective view, partly broken away, of the muck ring shown in the head of FIGS. 1 and 2.

Centred in cutting head 14 is a muck ring 54 which, as seen in FIG. 4, consists of a drum 56 axially oriented with the cutting head and having a circular side wall 58 and a pair of flat circular end walls 60 and 61 defining a chamber 62. End wall 61 has a rectangular opening 63. Side wall 58 is broken to provide an upper opening 64 which is closed by a pair of pressure relief gates 66 mounted on hinges 68 on side wall 56 at each end of the opening. A flange 70 is located on the inside of housing 56 below opening 64 and a pair of hydraulic cylinder 72 interconnect flange 70 with gates 66, each cylinder being pivotably connected at one end to the flange and the other end to one of the gates. Muck ring 54 is fixed to plate 46 of housing 12 by a flange 74 and is sealed in the opening of rear wall 20 of cutting head 14 by a friction O-ring 75, thus providing an atmospheric seal between cutting head 14 and the interior of housing 12.

Each gate 66 carries a sealing strip 76 which cooperates with side walls 60, 61 and the end of the gates remote from hinges 68 to seal the gates when closed. A pressure cell 78 is located on one end wall 60 of muck ring 54 outside chamber 62 and the pressure cell is connected to a pressure gauge mechanism 80 which actuates cylinders 72 to open and close gates 66.

A cantilever platform 82, fixed on plate 46 by flange 74, supports the forward end of an endless conveyor 84 which projects through opening 63 into chamber 64 of muck ring 54 below gates 66. Conveyor 84 extends rearwardly through housing 22 in known manner. Housing 22 is advanced forwardly in a tunnel 85 also in known manner, by the operation of a plurality of hydraulic jacks, not shown, which are mounted on the inner surface of the housing and bear against the tunnel lining.

Figure 2:
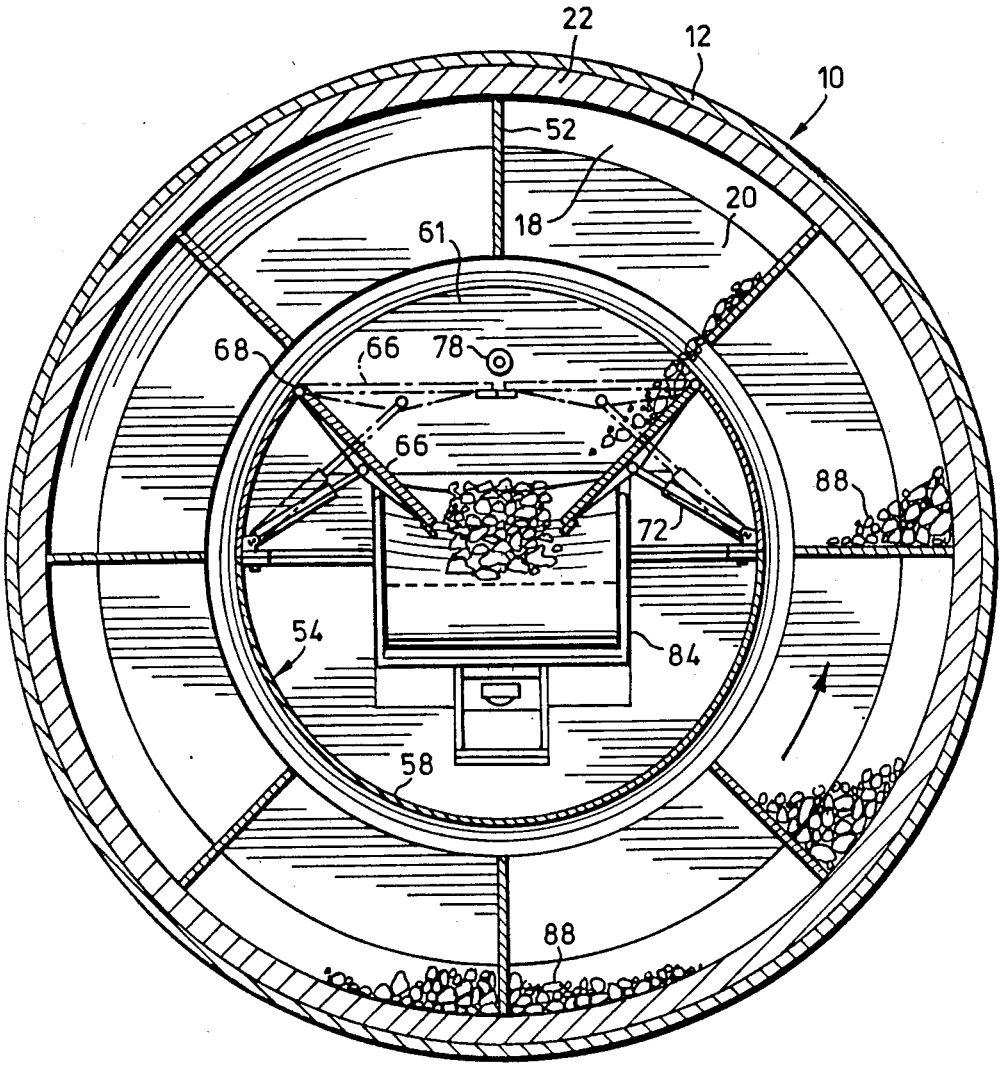
FIG. 2 is a cross-sectional view taken along line 2—2 of FIG. 1.
Figure 3:
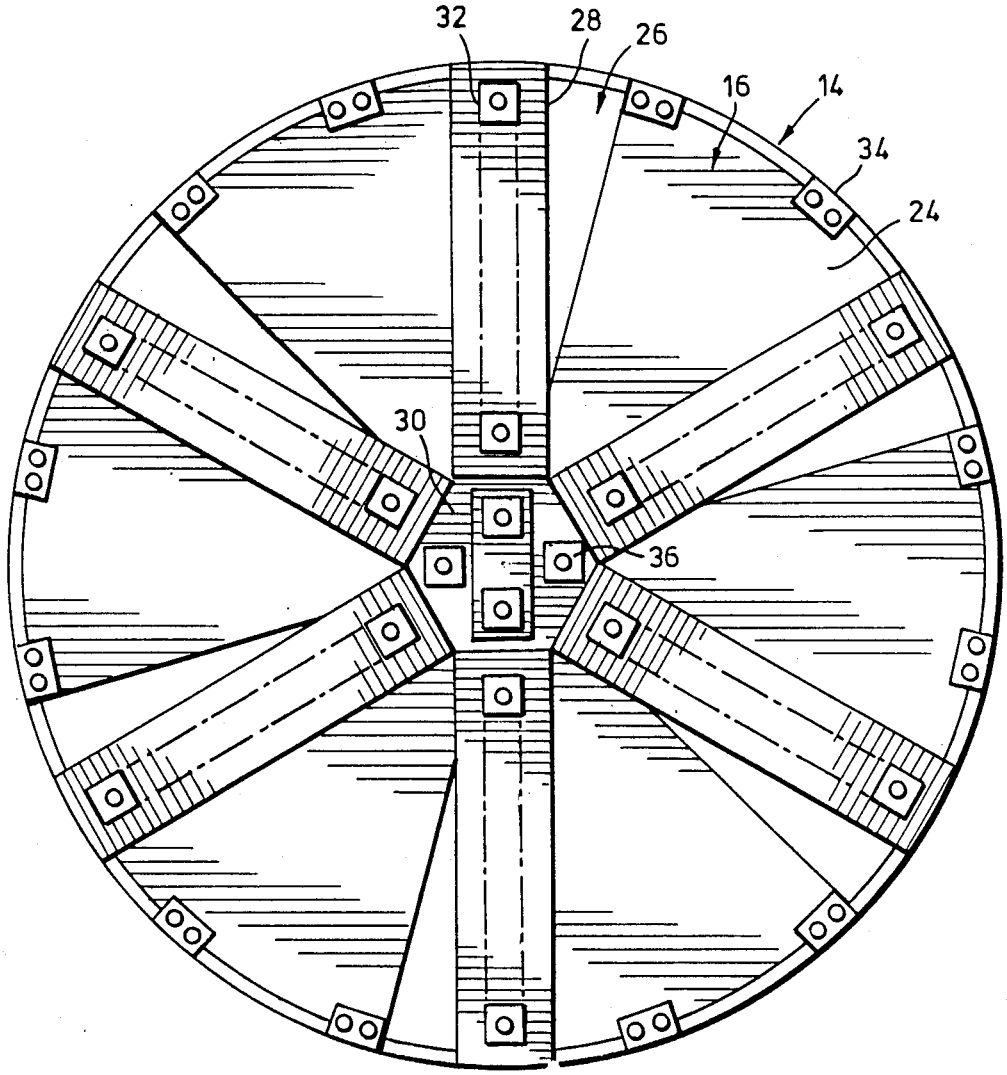
FIG. 3 is a front view in elevation of the head of FIG. 1.

In the operation of the apparatus shown in the drawings, cutting head 14 is rotated either clockwise or counter-clockwise on bearings 50 by motor 44. As cutting head 14 rotates, teeth 32 of cutter bars 28 bite into the soil of face 86 of tunnel 85 in front of the cutting head. Soil 88 loosened by the cutter bars passes through apertures 26 in face 16 to lodge against loading plates 52 where it is carried upwards until the loading plates reach a point above opening 64 of muck ring 54 whereupon the soil drops by gravity through the opening on to conveyor 22 when gates 66 are open, as seen in FIG. 2 of the drawings. If too much soil flows from face 86 of tunnel 85 through cutting head 14 onto conveyor 84, risking collapse of the tunnel face, pressure cell 78 senses the drop in pressure and signals pressure gauge 80 which actuates cylinders 72 to close gates 66, arresting the flow of soil through opening 64. Since pressure cell 78 is outside chamber 62 of muck ring 54 it continues to monitor the pressure in cutting head 14 and at face 86 of tunnel 85. When the pressure in head 14 increases to a predetermined value chosen to indicate that soil 88 is no longer entering head at an unacceptably high rate, a signal is sent to pressure gauge 80 which actuates cylinders 72 to open gates 66.

It will be seen that the present invention controls the flow of soil from the tunnel face through the tunnelling machine, which is important where the machine is boring through loose soil, allowing the head to be sealed from the housing interior.

I claim:

1. Apparatus for tunnelling through soil, comprising:

a housing;

a cutting head rotatably mounted on one end of the housing and closing said one end, the head being sealed from the housing, a muck ring fixed to the housing and projecting from the housing into the cutting head, the muck ring defining a chamber opening into the cutting head to receive loose soil collected within the cutting head; and closure means operable in response to earth pressure change within the cutting head to open and close the opening in the muck ring whereby a predetermined earth pressure is maintained in the cutting head.

2. Apparatus as claimed in claim 1 in which the closure means comprises gate means.

3. Apparatus as claimed in claim 1 including pressure sensitive means within the cutting head adapted to actuate the closure means.

4. Apparatus as claimed in claim 1 including means in the muck ring to receive the loose soil for removal therefrom through the housing.

5. Apparatus as claimed in claim 1 in which the closure means comprises a pair of gates hinged to opposed sides of the opening in the muck ring and opening into the chamber therein to form a chute.

6. Apparatus as claimed in claim 5 including means in the muck ring to receive the loose soil for removal therefrom through the housing.

7. Apparatus as claimed in claim 6 in which the soil removal means comprises an endless conveyor projecting into the muck ring.

8. Apparatus for tunnelling through soil, comprising:

a cylindrical housing;

a cutting head rotatably mounted on one end of the housing coaxial therewith and closing said one end, the head being sealed from the housing;

a muck ring fixed to the housing and defining a chamber, the muck ring projecting from the housing into the cutting head and having an opening located to receive loose soil collected within the cutting head and falling by gravity through the opening into the chamber;

means to remove the loose soil from the chamber through the housing;

gate means to open and close the opening in the muck ring; and means responsive to earth pressure change within the head to operate the gate means whereby a minimum earth pressure in the cutting head is maintained.

9. Apparatus as claimed in claim 8 in which the gate means comprises a pair of gates hinged on opposing sides of the opening in the muck ring to open and close the gates.

10. Apparatus as claimed in claim 9 in which the pressure responsive means comprises a pressure cell located in the cutting head and connected with a pressure gauge adapted to actuate the hydraulic cylinders of the gates.

11. Apparatus as claimed in claim 8 in which the muck ring comprises a drum axially oriented with the cutting head and having a circular side wall and a pair of flat end walls, the opening in the muck ring being located in the side wall, a plurality of loading plates being positioned radially in the cutting head between the periphery thereof and the side wall of the muck ring thereby loose soil entering the cutting head is carried upwardly to fall into the muck ring opening.

12. Apparatus as claimed in claim 8 in which the cutting head is journally mounted on a base plate fixed in the housing normal to the axis thereof and the muck ring is fixed to the base plate, the soil removal means comprising an endless conveyor belt projecting into the muck ring through an aperture in the base plate.

* * * * *